US008272972B2

(12) United States Patent
Sato et al.

(10) Patent No.: US 8,272,972 B2
(45) Date of Patent: Sep. 25, 2012

(54) GOLF CLUB, METHOD FOR CHANGING SHAFT INSERTION DEPTH OF GOLF CLUB, AND METHOD FOR REPLACING SHAFT OF GOLF CLUB

(75) Inventors: Fumiaki Sato, Chichibu (JP); Hiroshi Takahashi, Chichibu (JP); Hideo Matsunaga, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 195 days.

(21) Appl. No.: 12/645,964

(22) Filed: Dec. 23, 2009

(65) Prior Publication Data

US 2010/0234123 A1 Sep. 16, 2010

(30) Foreign Application Priority Data

Mar. 16, 2009 (JP) ..... 2009-063096

(51) Int. Cl.
*A63B 53/02* (2006.01)
*A63B 53/16* (2006.01)

(52) U.S. Cl. ..... 473/296; 473/288; 473/307; 473/309

(58) Field of Classification Search ..... 473/288, 473/307, 309–310, 244–248
See application file for complete search history.

(56) References Cited

U.S. PATENT DOCUMENTS

| | | | | |
|---|---|---|---|---|
| 7,326,126 | B2 * | 2/2008 | Holt et al. | 473/307 |
| 7,335,113 | B2 * | 2/2008 | Hocknell et al. | 473/307 |
| 7,476,160 | B2 * | 1/2009 | Hocknell et al. | 473/307 |
| 7,883,430 | B2 * | 2/2011 | Thomas et al. | 473/307 |
| 7,931,542 | B2 * | 4/2011 | Kusumoto | 473/288 |
| 2007/0173344 | A1 * | 7/2007 | Burch | 473/305 |
| 2010/0035701 | A1 * | 2/2010 | Kusumoto | 473/307 |

FOREIGN PATENT DOCUMENTS

| | | | |
|---|---|---|---|
| JP | 11-178954 | A | 7/1999 |
| JP | 2000-005349 | A | 1/2000 |
| JP | 2003-070940 | A | 3/2003 |

* cited by examiner

*Primary Examiner* — Stephen L. Blau
(74) *Attorney, Agent, or Firm* — Sughrue Mion, PLLC

(57) ABSTRACT

A golf club, includes: a head; a shaft; a shaft case, having a cylindrical shape and fixed to a leading end of the shaft, a hosel, mounted on the head, wherein: the shaft case is inserted into the hosel from an upper end of the hosel; and the shaft case is fixed to the hosel so that an insertion depth of the shaft into the hosel is changed.

8 Claims, 12 Drawing Sheets

GOLF CLUB, METHOD FOR CHANGING SHAFT INSERTION DEPTH OF GOLF CLUB, AND METHOD FOR REPLACING SHAFT OF GOLF CLUB

BACKGROUND

1. Field of the Invention

The present invention relates to a golf club. Specifically, the invention relates to a golf club the shaft of which can be replaced easily. Also, the invention relates to a method for changing the shaft insertion depth of such golf club and a method for replacing the shaft of such golf club.

2. Description of the Related Art

A golf club is structured such that a head is mounted on the leading end portion of a shaft, while a grip is mounted on the base end portion of the shaft.

Referring to the structure of a conventional ordinary golf club head, a hosel hole is formed directly in the head, while the shaft is inserted into the hosel hole and is fixed thereto using an adhesive agent. Here, as the adhesive agent, generally, there is used an epoxy-system adhesive agent. To replace the shaft, the hosel portion of the head may be heated to destroy the structure thereof that is formed of the hardened epoxy resin of the adhesive agent, whereby the shaft can be then pulled out of the hosel portion of the head.

In JP-A-11-178954, there is disclosed a golf club head structured such that a head main body and a hosel are produced separately from each other and the hosel is then fixed to the head main body using a screw. In JP-A-11-178954, a plate-shaped neck portion is formed on the lower end side of the hosel, and the neck portion is inserted into the insertion portion of the head main body and is fixed thereto using a screw. Thus, since the plate-shaped neck portion is fixed to the head main body in this manner, in the impact time when a golfer hits a ball with the head, the neck portion is allowed to bend, thereby relieving the concentration of stresses occurring in the connecting portion between the shaft and hosel.

In the golf club head disclosed in JP-A-11-178954, the shaft insertion depth of the head cannot be changed.

Thus, it is an object of the invention to provide a golf club the shaft case insertion depth of which can be changed and a method for changing the shaft insertion depth of such golf club.

Also, in the golf club head disclosed in JP-A-11-178954, the connecting strength between the head main body and hosel as well as the rigidity thereof are both insufficient, whereby a strong impact feeling cannot be obtained. Also, the position of the hosel is excessively high.

SUMMARY

According to an aspect of the invention, there are provided a golf club structured such that a shaft equipped with a shaft case, which is formed separately from a head, can be strongly fixed to the head and the shaft case can be easily mounted onto and removed from the head; and, a method for changing the shaft insertion depth of such golf club and a method for replacing the shaft of such golf club.

According to an aspect of the invention, there is provided a golf club, includes: a head; a shaft; a shaft case, having a cylindrical shape and fixed to a leading end of the shaft, a hosel, mounted on the head, wherein: the shaft case is inserted into the hosel from an upper end of the hosel; and the shaft case is fixed to the hosel so that an insertion depth of the shaft into the hosel is changed.

The shaft case may be fixed to the hosel by a ring-shaped screw member removably screwed on the upper end of the hosel.

A lower end of the shaft case may be closed, an upper end of the shaft case may be opened, and the shaft may be inserted into the shaft case and is fixed thereto using an adhesive agent.

The golf club may includes: a spacer, disposed between the lower end of the shaft case and a bottom portion of the hosel; a female screw, formed in an inner peripheral surface of the upper end of the hosel; a first screw member, threadedly engaged with the upper end of the hosel, the first screw member being concentrically with the hosel; a female screw, formed in the inner peripheral surface of an upper end of the first screw member; a second screw member, including a male screw being threadedly engaged with the female screw of the first screw member, wherein when the spacer and the first screw member are removed and the second screw member is threadedly engaged with the female screw of the hosel directly, the insertion depth of the shaft is increased.

A lower end face of the screw member may be pressed against an upper end face of the shaft case.

The golf club may include a projecting portion, provided on an outer peripheral surface of the shaft case.

The lower end face of the second screw member may be pressed against the projecting portion.

The spacer may include an engaging unit, configured to engage a jig which is used to pull out the spacer from the hosel.

The engaging unit may be a female screw.

A method for changing the shaft insertion depth of the golf club, the method includes: removing the second screw member from the first screw member; removing the first screw member from the hosel; pulling out the shaft case from the hosel; taking out the spacer from the hosel; inserting the shaft case into the hosel; and threadedly engaging the second screw member with the hosel.

A method for changing the insertion depth of the shaft of the golf club, the method includes: replacing the second screw member and spacer with another second screw member and spacer which are different in length in the axial direction of the hosel.

The method according to the above, may further includes: providing a weight adjusting portion in the head; and adjusting the insertion depth based on a weight of the head.

A method for replacing the shaft of the golf club, the method includes: fixing a new shaft to a new shaft case to form a connected unit; removing the shaft case and the shaft from the head; and mounting the connected unit onto the head.

According to a golf club of the invention, the insertion depth of the shaft into the hosel can be adjusted. Therefore, in a golf club including the same head and the same shaft, when the length of the shaft case is changed, a golfer can easily find the length of the shaft suitable for the golfer.

According to a golf club as set forth in Claim 2, since the shaft case is inserted into the cylindrical hosel and is fixed thereto with a screw member, the shaft case can be mounted onto the hosel firmly.

According to a golf club as set forth in Claim 3, the shaft can be inserted into the deep portion of the shaft case and can be thereby bonded thereto firmly.

According to a golf club as set forth in Claims 2 to 7, by changing the insertion depth of the shaft case, the shaft insertion depth can be changed.

According to a shaft insertion depth changing method as set forth in Claim 9, by removing the spacer and cylindrical member, the shaft insertion depth can be increased or changed. When the removed spacer and cylindrical member are mounted again, the shaft insertion depth can be reduced.

According to a shaft insertion depth changing method as set forth in Claim 10, by replacing the spacer and cylindrical member with another spacer and cylindrical member which are different in length in the hosel axial direction from the existing ones, the shaft insertion depth can be changed.

According to a shaft replacing method as set forth in Claim 12, when the screw member is loosened and removed, the shaft case can be pulled out of the hosel. Specifically, a new shaft case is connected to a shaft to provide a new shaft case/shaft connected unit previously. And, when the new shaft case/shaft connected unit is inserted into the above hosel and the screw member is threadedly engaged, the shaft can be replaced.

According to this shaft replacing method, it is possible to omit a conventional troublesome labor and time requiring operation in which the adhesive agent is heated to destroy the structure of the adhesive agent, an existing shaft is removed from the head main body, and a new shaft is then mounted again onto the head main body using an adhesive agent. Therefore, an existing shaft can be removed from the head of a golf club just after it is used for a ball hitting try, and another new shaft having different properties can be mounted quickly onto the same head for another hitting trial using the golf club. Owing to this, in a golf shop and the like, it is very easy for the golfer to find a proper golf club.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

Now, description will be given below of a first embodiment according to the invention with reference to the accompanying drawings.

Figure 1:
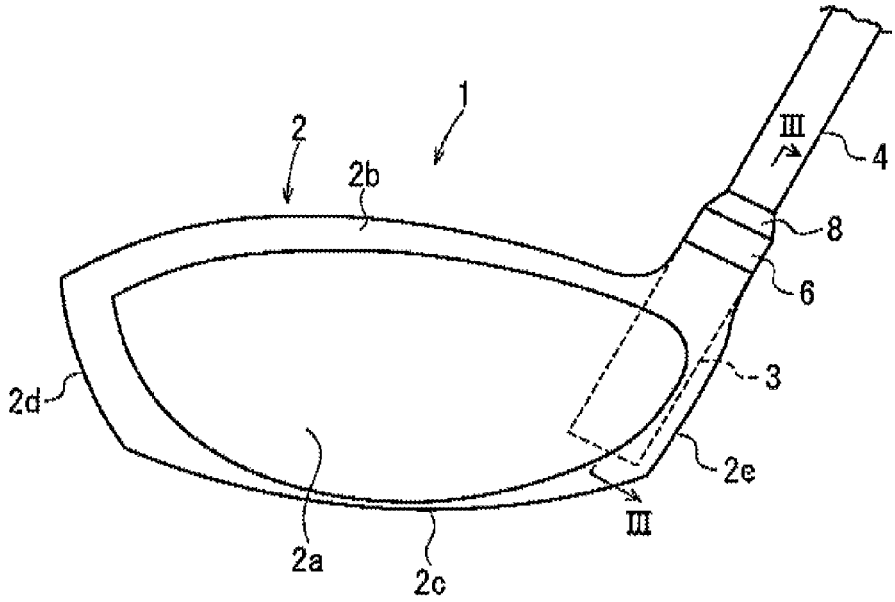
FIG. 1 is a front view of a golf club head according to an embodiment of the invention.
Figure 2:
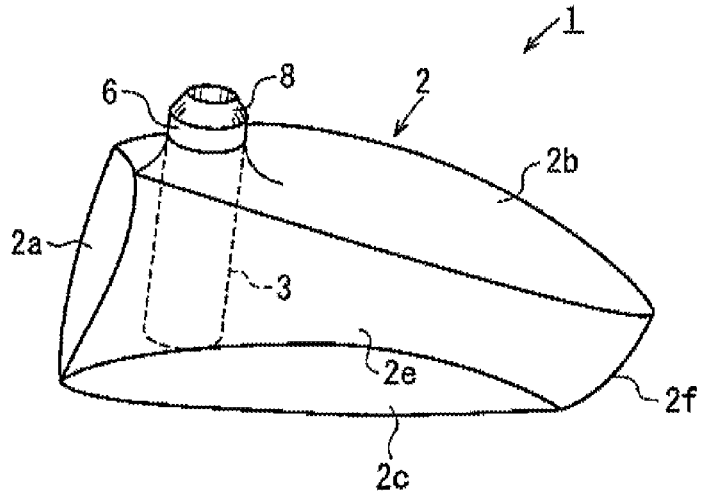
FIG. 2 is a side view of the heel side of the golf club head.
Figure 3:
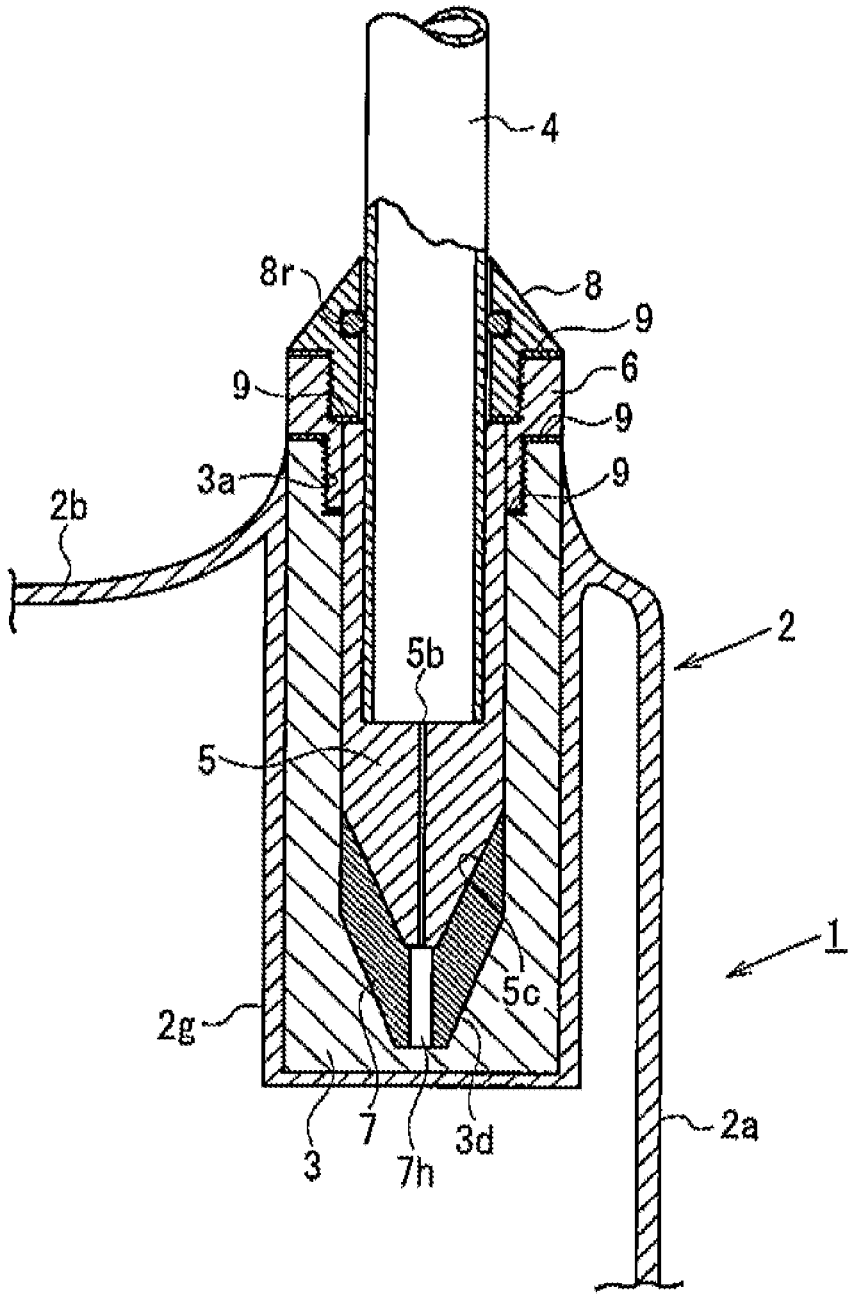
FIG. 3 is a section view taken along the arrow line shown in FIG. 1.
Figure 4:
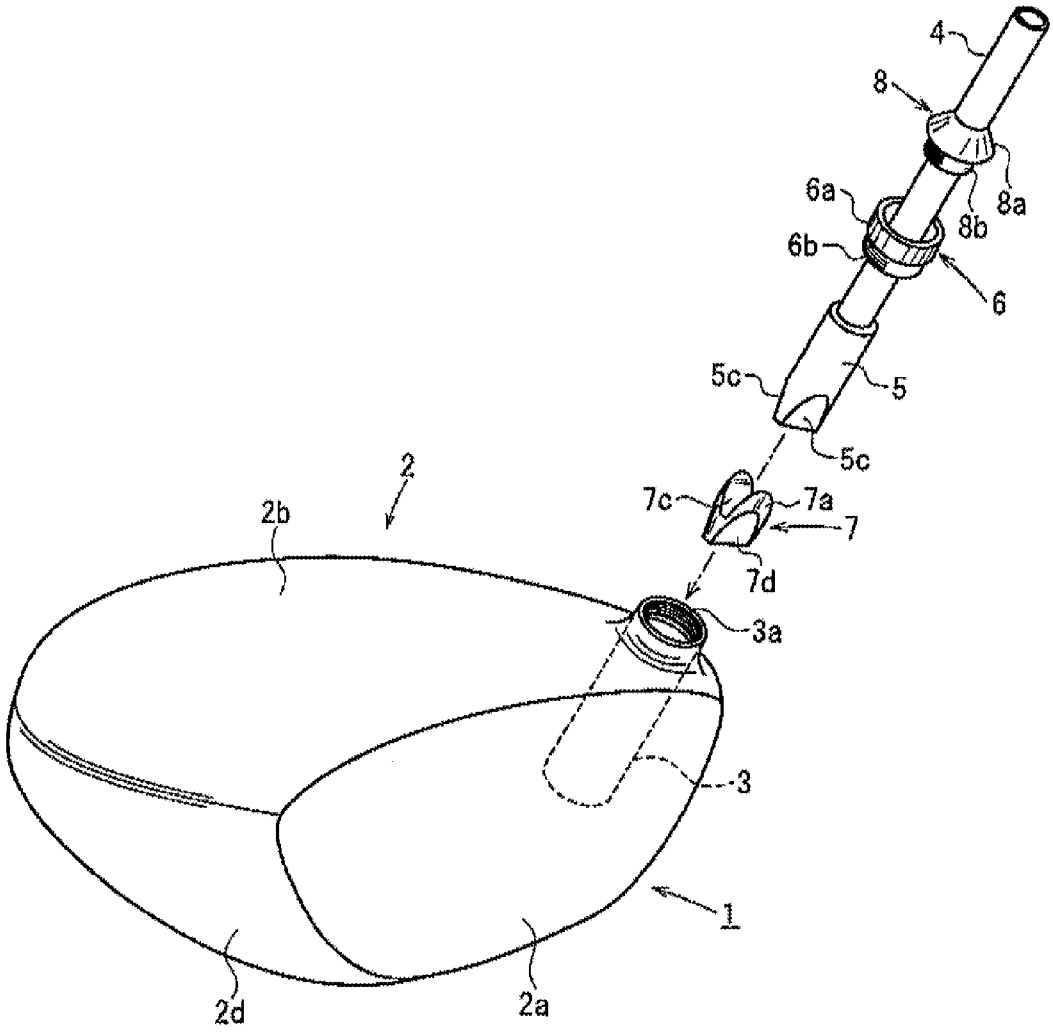
FIG. 4 is an exploded perspective view of the golf club head.
Figure 5:
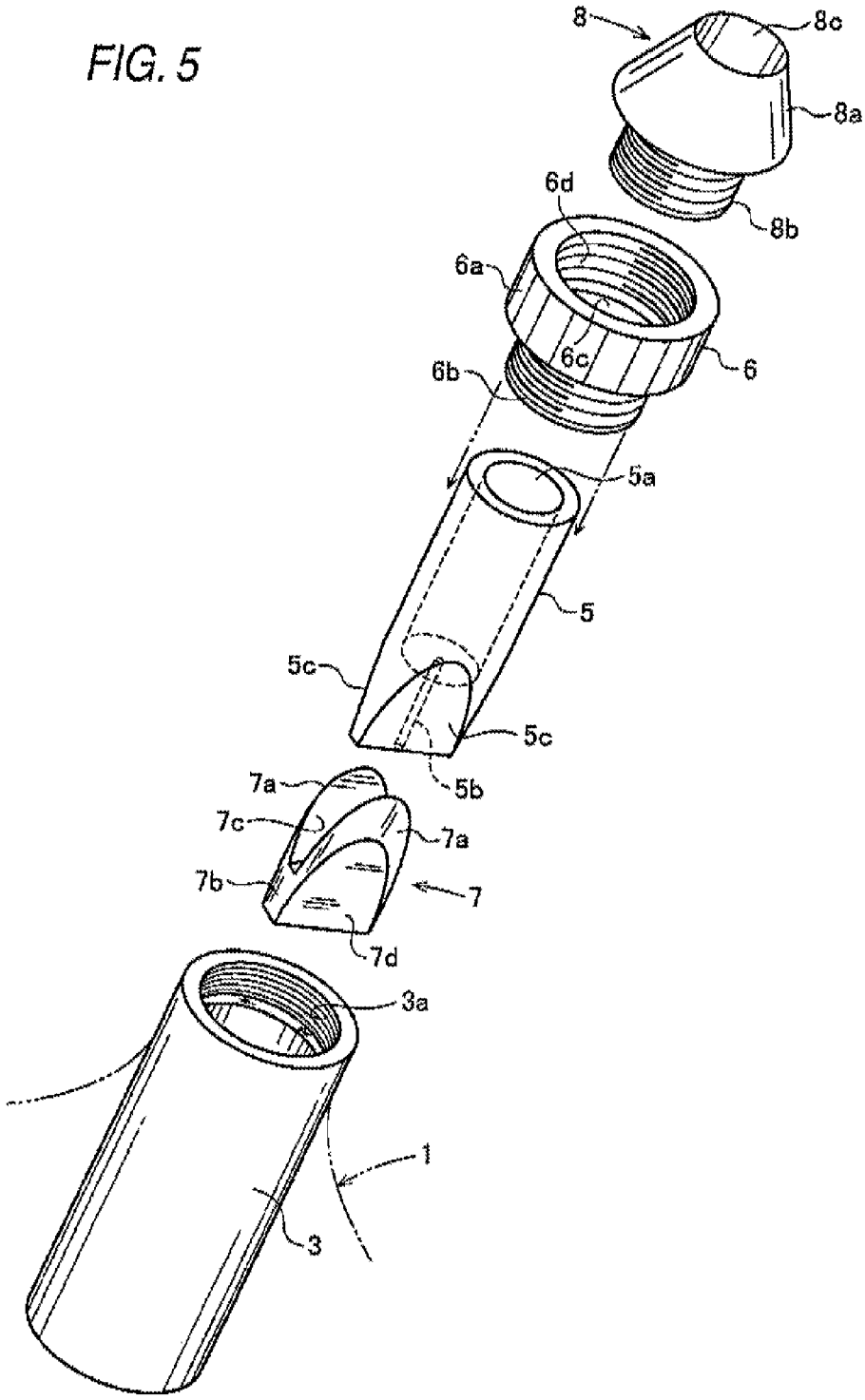
FIG. 5 is a perspective view of a hosel, a spacer, a shaft case and a screw member.
Figure 6:
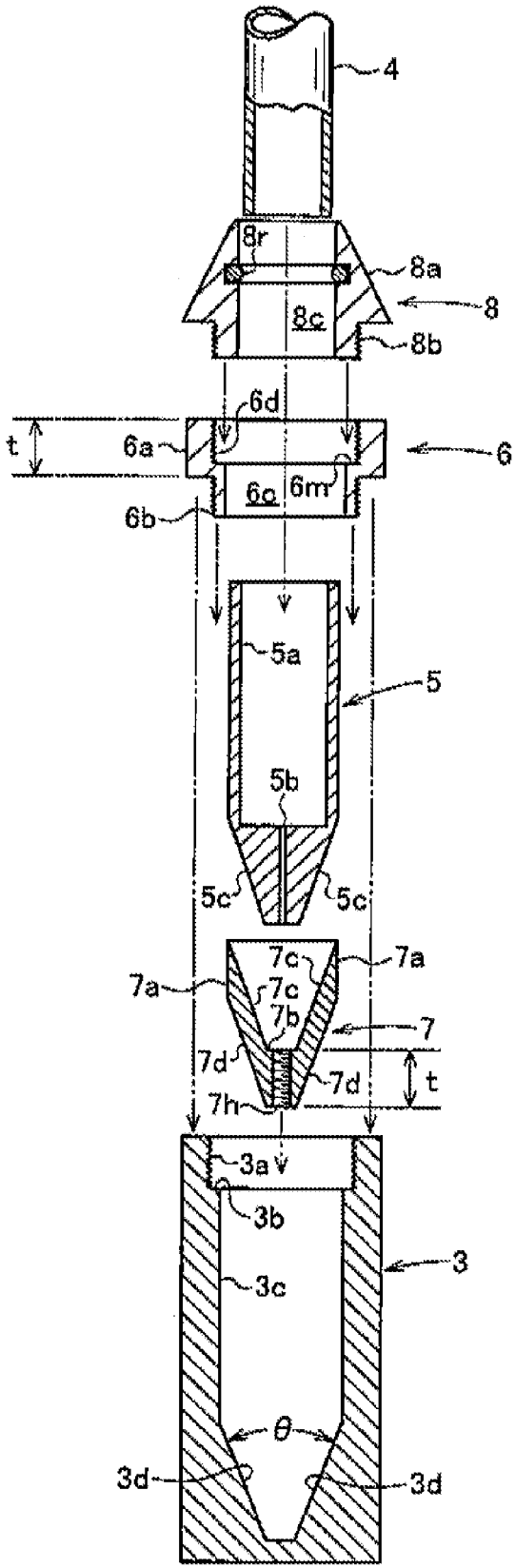
FIG. 6 is a section view of the hosel, spacer, shaft case and screw member.
Figure 7:
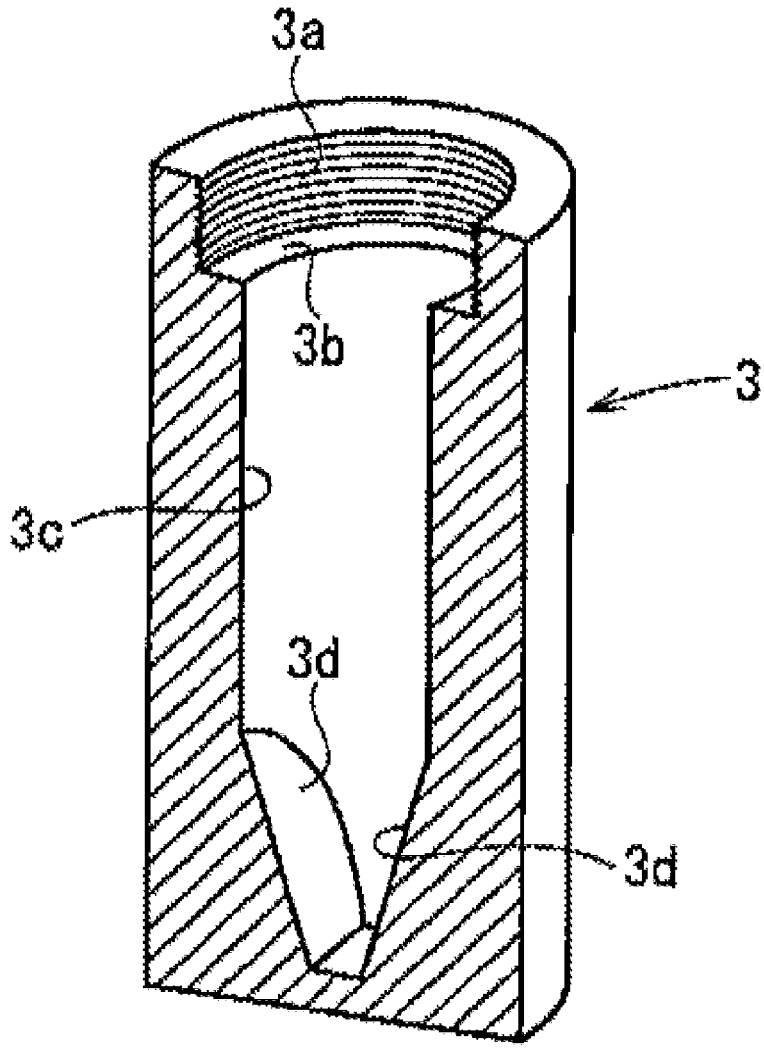
FIG. 7 is a perspective section view of the hosel.
Figure 8:
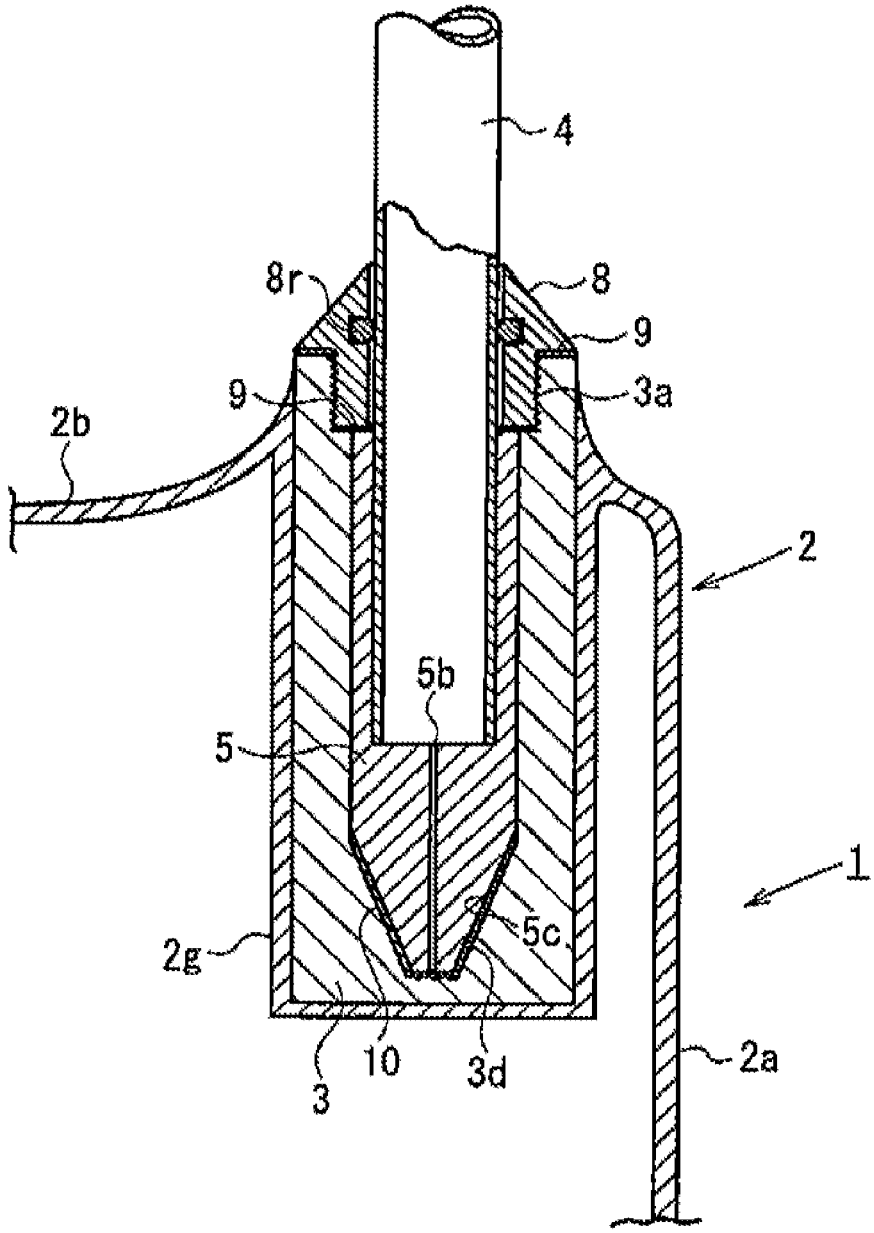
FIG. 8 is a section view of a golf club according to the present embodiment, showing a case where the shaft insertion depth thereof is increased.

Specifically, FIG. 1 is a front view of a golf club head according to a first embodiment of the invention. FIG. 2 is a side view of the heel side of the golf club head. FIG. 3 is a section view taken along the arrow line shown in FIG. 1. FIG. 4 is an exploded perspective view of the golf club head. FIG. 5 is a perspective view of a hosel, a spacer, a shaft case and a screw member. FIG. 6 is a section view of the hosel, spacer, shaft case and screw member. FIG. 7 is a perspective section view of the hosel. FIG. 8 is a section view of the golf club according to the present embodiment, showing a case when the spacer and screw member are removed and the shaft is inserted deeply.

Referring to the structure of this golf club, a shaft 4 is mounted on the hosel 3 of a head 1 through a shaft case 5, screw members 6, 8 and a spacer 7.

This head 1 includes a head main body 2 and a hosel 3 mounted on the head main body 2, while the head 1 is of a hollow wood type. And, the head main body 2 includes a face portion 2*a*, a crown portion 2*b*, a sole portion 2*c*, a toe portion 2*d*, a heel portion 2*e* and a back portion 2*f*.

As shown in FIG. 3, in such portion of the crown portion 2*b* as faces the face portion 2*a* and heel portion 2*e*, there is formed a cylindrical hosel installation portion 2*g*. This hosel installation portion 2*g* has a cylindrical shape with its upper end opened and its lower end closed, while this portion 2*g* extends coaxially with the shaft 4. The hosel 3 is inserted into the hosel installation portion 2*g* from above and is fixed there using proper fixing means such as welding, brazing, bonding, shrinkage fitting and expansion fitting.

As shown in FIGS. 5 to 7, the hosel 3 has a substantially cylindrical shape including a hole which is formed to extend in the axial direction of the hosel 3 from its upper end toward its lower end.

On the entrance side of the hole, that is, in the inner peripheral surface of the hosel upper end side of the hole, there is formed a female screw 3*a*. Continuously with the lower end portion of the female screw 3*a*, there is formed a step portion 3*b* which extends in the decreasing diameter direction of the hosel 3; and the portion of the hosel 3, which exists more deeply than the step portion 3*b*, is formed as a cylindrical portion 3*c*. More deeply of the cylindrical portion 3*c*, there are formed a pair of inclined surfaces 3*d* and 3*d* which respectively cross the axis of the hosel 3 obliquely. The two inclined surfaces 3*d* and 3*d* are arranged symmetrically with the axis of the hosel 3 between them. The distance between the two inclined surfaces 3*d* and 3*d*, that is, the spacing between them in the perpendicularly crossing direction with the hosel axis decreases toward the lower end of the hosel 3. The crossing angle θ (FIG. 6) between the two inclined surfaces 3*d* and 3*d* may preferably be approximately 10 to 30°, more preferably, approximately 15 to 20°. Here, although not shown, the deep portion of the hosel hole may also be formed to have a pyramid shape such as a square pyramid shape.

As shown in FIGS. 5 and 6, the shaft case 5 is a cylindrical member which is very slightly smaller in diameter than the cylindrical portion 3*c* of the hosel 3. The shaft case 5 includes a hole 5*a* for insertion of the shaft 4 extending from the upper end portion of the shaft case 5 toward the lower end portion thereof. The length of the cylindrical portion of the hole 5*a* may be approximately 10 mm or more, for example, approximately 10 to 50 mm, more preferably, approximately 20 to 40 mm. In such portion of the shaft case 5 as exists from the deep bottom surface of the hole 5*a* to the lower end face of the shaft case 5, there is opened up a small hole 5*b* for air bleeding. Here, the cylindrical portion of the shaft case hole 5*a* may preferably extend to a position where the inclined surfaces 3*d* are formed. According to the present embodiment, since impacts generated in the hitting time are to be received by the inclined surfaces 3*d*, the present golf club can provide a hitting feeling which is near to an ordinary golf club structured such that a head and a shaft are fixed to each other using an adhesive agent.

In the outer surface of the lower end side of the shaft case 5, there are formed a pair of inclined surfaces 5*c* and 5*c*. The inclined surfaces 5*c* and 5*c* are arranged symmetrically with the axis of the shaft case 5 between them. The distance between the two inclined surfaces 5*c*, 5*c*, that is, the spacing between them in the perpendicularly crossing direction with the axis of the shaft case 5 decreases toward the lower end side of the shaft case 5. The crossing angle between the two inclined surfaces 5*c* and 5*c* is the same as the crossing angle θ between the two inclined surfaces 3*d* and 3*d*.

Here, although not shown, the inner peripheral edge of the upper end portion of the shaft case 5 may also be chamfered at an angle of approximately 20 to 45° for easy insertion of the shaft 4. Also, the outside diameter of the upper end portion of the shaft case 5 may also be increased to thereby form such upper end portion as a flange-like portion. In this case, as will be discussed later, when the lower end face of the screw member 8 is pressed against the upper end face of the shaft case 5, the pressing area can be increased.

Between the shaft case 5 and the deepest portion of the hosel 3, there is interposed a spacer 7. The spacer 7 has a V-like shape when it is viewed from the side surface thereof. And, the spacer 7 includes a bottom portion 7*b* and a pair of rising portions 7*a*, 7*a* respectively rising from the bottom portion 7*b*. The spacer 7 includes a pair of outer inclined surfaces 7*d* and 7*d* which can respectively be engaged with the inclined surfaces 3*d* and 3*d* of the hosel 3, and a pair of inner inclined surfaces 7*c* and 7*c* respectively engageable with the inclined surfaces 5*c* and 5*c* of the shaft case 5. Thus, the spacer 7 includes an outer surface shape fittable with the deepest portion of the hosel 3 and an inner surface shape with which the shaft case 5 can be fitted.

In the bottom portion 7*b* of the spacer 7, there is formed a female screw hole 7*h*. When the leading end of an elongated rod-like jig is screwed into this female screw hole 7*h*, the spacer 7 can be easily inserted into and removed from the hosel 3. In order to prevent the spacer 7 from shaking or generating strange sounds, preferably, the spacer 7 may be made of metal, more preferably, it may be made of an alloy, most preferably, it may be made of a titanium alloy, a magnesium alloy, or an aluminum alloy having a low specific gravity. Also, for prevention of the strange sounds, the spacer 7 may also be made of elastic material such as rubber or elastomer; and also, it may also be made of foaming material such as foaming rubber, foaming resin or foaming elastomer, because the foaming material has a low specific gravity. The thickness of the spacer 7 may be 0.25 inches (6.3 mm) or more, more preferably, approximately 0.25 to 1.5 inches. When preparing spacers having different thicknesses, preferably, they may be prepared at regular intervals, for example, 0.25", 05", 0.75", 1.0" - - - . In this case, for the first screw member 6 as well, preferably, there may be prepared screw members which respectively correspond to the respective lengths of spacers used.

The first screw member 6 has a substantially ring-like shape. The lower half portion of the first screw member 6 is formed smaller in diameter than the upper half portion 6*a* thereof and, in the outer peripheral surface of the lower half portion, there is formed a male screw 6*b*. The lower half portion of the screw member 6 has such diameter as allows the male screw 6*b* to be threadedly engaged with the female screw 3*a* of the hosel 3. The screw member 6 includes a hole 6*c* which penetrates through the screw member 6 in the axial direction of the screw member 6 and into which the shaft case 5 can be inserted. The upper portion of the hole 6*c* is formed larger in diameter than the lower portion of the hole 6*c* and includes a female screw 6*d*. Between the large-diameter upper portion of the hole 6*c* and the small-diameter lower portion thereof, there is interposed a step surface 6*m* (FIG. 6).

The vertical thickness t of the large diameter portion 6*a* of the screw member 6 is set equal to the thickness t of the bottom portion 7*b* of the spacer 7.

The second screw member 8 includes a male screw 8*b* formed in the outer periphery of the cylindrical lower half portion thereof, while the upper half portion of the second screw member 8 is formed as a tapered umbrella-shaped portion 8*a* the diameter of which decreases as it goes toward its upper end. The diameter of the lower end of the umbrella-shaped portion 8*a* is set equal to the diameter of the upper half portion 6*a* of the screw member 6.

The screw member 8 includes a hole 8*c* which penetrates through the screw member 8 in the vertical direction. The diameter of the hole 8*c* is set slightly larger than the diameter of the shaft 4. On the inner peripheral surface of the hole 8*c*, there is mounted an O ring 8*r* made of rubber, elastomer or the like and the inner periphery of the O ring 8*r* is contacted with the shaft 4. This can enhance the sliding performance between the shaft 4 and the inner peripheral surface of the hole 8*c* and also can prevent the shaft 4 against shaking motion. Also, between the first and second screw members 6 and 8, between the screw member 6 and hosel 3, and between the screw member 8 and the end face of the shaft case 5, there are respectively interposed ring-shaped thin layers 9 each made of elastic material such as rubber or elastomer.

To assemble the golf club, as shown in FIG. 4, the screw members 8 and 6 are respectively fitted with shaft 4 from the leading end side of the shaft 4 and the shaft case 5 is fixed to the leading end of the shaft 4 using an adhesive agent previously. Preferably, the adhesive agent may be applied to the outer peripheral surface of the leading end portion of the shaft 4, and the shaft 4 may be then inserted into the deepest portion of the hole 5*a* of the shaft case 5.

Here, since the small hole 5*b* is formed in the shaft case 5, when the shaft 4 is inserted into the hole 5*a* of the shaft case 5, the air is allowed to flow out through the small hole 5*b*. As the adhesive agent, preferably, there may be used an epoxy-system adhesive agent.

The screw member 6 is fitted with the outer surface of the shaft case 5. The screw members 6 and 8 are fitted in this manner and also the shaft case 5 of a shaft case/shaft connected unit, in which the shaft case 5 is fixed to the shaft 4, is inserted into the hosel 3 of the head 1 through the spacer 7 as shown in FIGS. 3 to 6. And, the shaft case 5 and spacer 7 are respectively inserted into the hosel 3. As clearly shown in FIG. 6, the inclines surfaces 5*c* and 5*c* are made to face the inclined surfaces 7*c* and 7*c* respectively, while the inclined surfaces 7*c*, 7*c* and inclines surfaces 3*d*, 3*d* are superimposed on top of each other. Next, the male screw 6*b* of the screw member 6 is threadedly engaged into the female screw 3*a* of the hosel 3. Further, the male screw 8*b* of the screw member 8 is threadedly engaged into the female screw 6*d* of the screw member 6.

Thus, as shown in FIG. 3, the lower end face of the screw member 8 is contacted with the upper end face of the shaft case 5 and the lower portion of the shaft case 5 including the inclined surfaces 5*c* is engaged with the inclined surfaces 3*d* of the hosel 3 through the spacer 7, whereby the shaft case 5 is fixed to the hosel 3. This completes the assembling of the golf club in which the shaft 4 and head 1 are connected together as an integral body, because the shaft case 5 and shaft 4 are firmly bonded to each other with the adhesive agent. In this golf club, since the shaft case 5 equipped with the shaft 4 is inserted into the hosel 3 and is then fixed there using the screw members 6 and 8, the mounting strength and rigidity of the shaft 4 and shaft case 5 are high.

Here, when the spacer 7 is made of rubber, elastomer, synthetic resin or the like, the spacer can absorb impacts and vibrations caused in the impact time.

To increase the insertion depth of the shaft 4, as shown in FIG. 8, the spacer 7 and screw member 6 are removed and the male screw 8*b* of the screw member 8 is threadedly engaged directly into the male screw 3*a* of the hosel 3. In this case, the shaft 4 can be inserted into the hosel 4 more deeply by an amount equivalent to the thickness t of the spacer 7. Here, in this case, preferably, there may be interposed a thin-piece-shaped elastic member 10 made of rubber, elastomer, synthetic resin or the like between the inclined surfaces 3*d* of the hosel 3 and the inclined surfaces 5*c* of the shaft case 5 to thereby be able to absorb the above-mentioned impacts and vibrations.

Alternatively, instead of removing the spacer 7 and screw member 6, by replacing the spacer 7 and screw member 6 with another spacer and screw member having different dimensions in the axial direction of the hosel 3, the insertion depth of the shaft 4 can be changed.

According to the present embodiment, due to formation of the female screw 7*h* in the spacer 7, when a rod-shaped jig having a male screw in the leading end thereof is screwed into the hosel 3 and the male screw is threadedly engaged with the female screw 7*h*, the spacer 7 can be taken out from the hosel 3 easily. To mount the spacer 7 into the hosel 3 as well, this jig may also be used.

To replace the shaft of the golf club, a shaft case of the same type as the shaft case 5 may be previously fixed to a new shaft to be used as a replacement using an adhesive agent. Here, the screw member 8 may also be mounted on the shaft previously. As the need arises, the screw member 6 may also be mounted previously.

The screw member 8 of the existing golf club is removed, and the old shaft 4 is removed from the head 1 together with the old shaft case 5 and screw member 8. Next, the new shaft with a shaft case and screw member connected thereto (the shaft case/shaft connected unit) is inserted into the head 1 and is then fixed thereto by tightening the screw member 8.

Thus, according to the present embodiment, the mounting and replacement of the shaft can be carried out very simply and quickly. Here, conventionally, to replace a shaft, the hosel portion of an existing golf club is heated to destroy the structure of the hardened material of an adhesive agent, an existing shaft is removed and, after then, a new shaft is fixed to the hosel portion of the head using an adhesive agent. This shaft replacing operation requires about several hours to one day or so. On the other hand, according to the above embodiment of the invention, since a new shaft is previously mounted on the shaft case 5 using an adhesive agent, the shaft replacing operation can be carried out in several minutes or so. Therefore, it is possible to realize a golf club using system in which there are previously prepared multiple shafts having various specifications, each shaft having a shaft case connected thereto, and the prepared different shafts are mounted sequentially one by one onto the same head main body for successive hitting trials.

According to the present embodiment, the arrangement of the inclined surfaces 3*d*, 5*c*, 7*c* and 7*d* can reduce the shaking motion of the shaft 4 and also can prevent the shaft 4 from rotating around the axial direction of the shaft 4. That is, the fixation rigidity of the shaft 4 in the torque direction is high.

Also, since the paired inclined surfaces 5*c* and 5*c* are arranged and the leading end portion of the shaft case 5 is thereby tapered, the shaft case 5 can be inserted into the hosel 3 easily.

The above-mentioned hosel, shaft case and screw member, preferably, may be made of metal and, more preferably, they may be made of aluminum, titanium, or their alloys. The hosel 3, which is produced separately from the head 1, may preferably be made of the material that has a specific gravity equivalent to or lower than the head main body 2: that is, the hosel 3 may also be made of, for example, a titanium alloy, aluminum, an aluminum alloy, a magnesium alloy, FRP, or synthetic resin.

The material of the golf club head is not limited to any specific one. However, when the golf club head is of a wood type, it can be made of a titanium alloy, an aluminum alloy, stainless steel or the like.

According to the invention, as described above, by removing the screw member 6 and spacer 7, or by replacing the screw member 6 and spacer 7 with another screw member and spacer having different dimensions, the shaft insertion depth is changed. Specifically, by removing or replacing the screw member 6 and spacer 7, the weight and center of gravity of the head can be respectively changed. Thus, according to the invention, preferably, there may be formed a weight adjusting portion in the head. Specifically, there is formed a weight adjusting screw hole in the sole portion, back portion, or side portion of the golf club head, and one of screws having different weights is mounted into the weight adjusting screw hole to thereby adjust the weight of the head. When, for such screws, there are used screws which are different in length and are made of different materials (for example, resin such as nylon, aluminum, magnesium, titanium, their alloys, stainless steel, and tungsten alloy), the weight of the head can be adjusted.

Here, in the illustrated golf club head of a hollow type, due to provision of the hosel 3, hosel installation portion 2*g*, shaft case 5, and screw members 6, 8, the weight of the heel side of the head is larger than that of an ordinary golf club head. In view of this, preferably, by increasing the thickness of the toe side or back portion thereof or by providing a weight on the toe side thereof, the golf club head may be balanced well.

Figure 9:
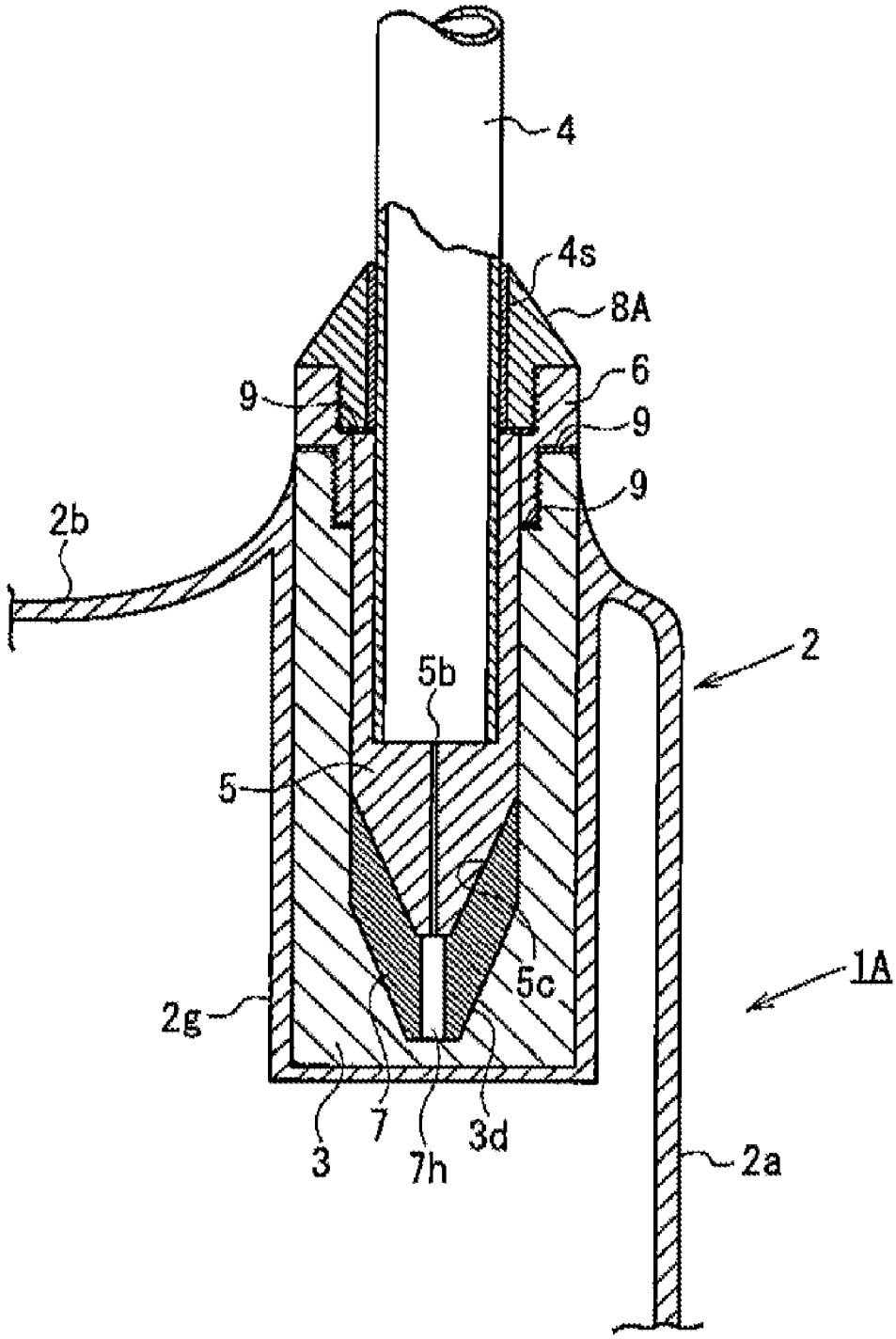
FIG. 9 is a section view of a golf club according to a second embodiment of the invention.

Embodiment Shown in FIG. 9

According to the invention, as shown in FIG. 9, there may also be used a second screw member 8A with the O ring 8*r* removed therefrom and, instead of the O ring 8*r*, between the inner peripheral surface of the screw member 8A and the outer peripheral surface of the shaft 4, there may be interposed a thin cylindrical sleeve 4*s* made of elastic material such as rubber or elastomer. The inner peripheral surface of the sleeve 4*s* is contacted with the shaft 4, while the outer peripheral surface thereof is contacted with the inner peripheral surface of the screw member 8A. The screw member 8A has the same shape as the screw member 8 except that the O ring mounting groove is removed therefrom. The other remaining structures of the embodiment shown in FIG. 9 are the same as the embodiment shown in FIG. 3 and thus the same parts thereof are given the same designations. In this golf club 1A as well, similarly to the above-mentioned golf club 1, the shaft insertion depth of the club 1A can be changed and the shaft of the club 1A can be replaced.

Here, in the inner peripheral surface of the sleeve 4*s*, there may also be formed an uneven portion such as a female screw which is formed in the inner peripheral surface of a nut. In this case, a frictional force between the inner peripheral surface of the sleeve 4*s* and shaft 4 can be reduced, whereby the sleeve 4*s* can be mounted onto and removed from the shaft 4 smoothly.

Figure 10:
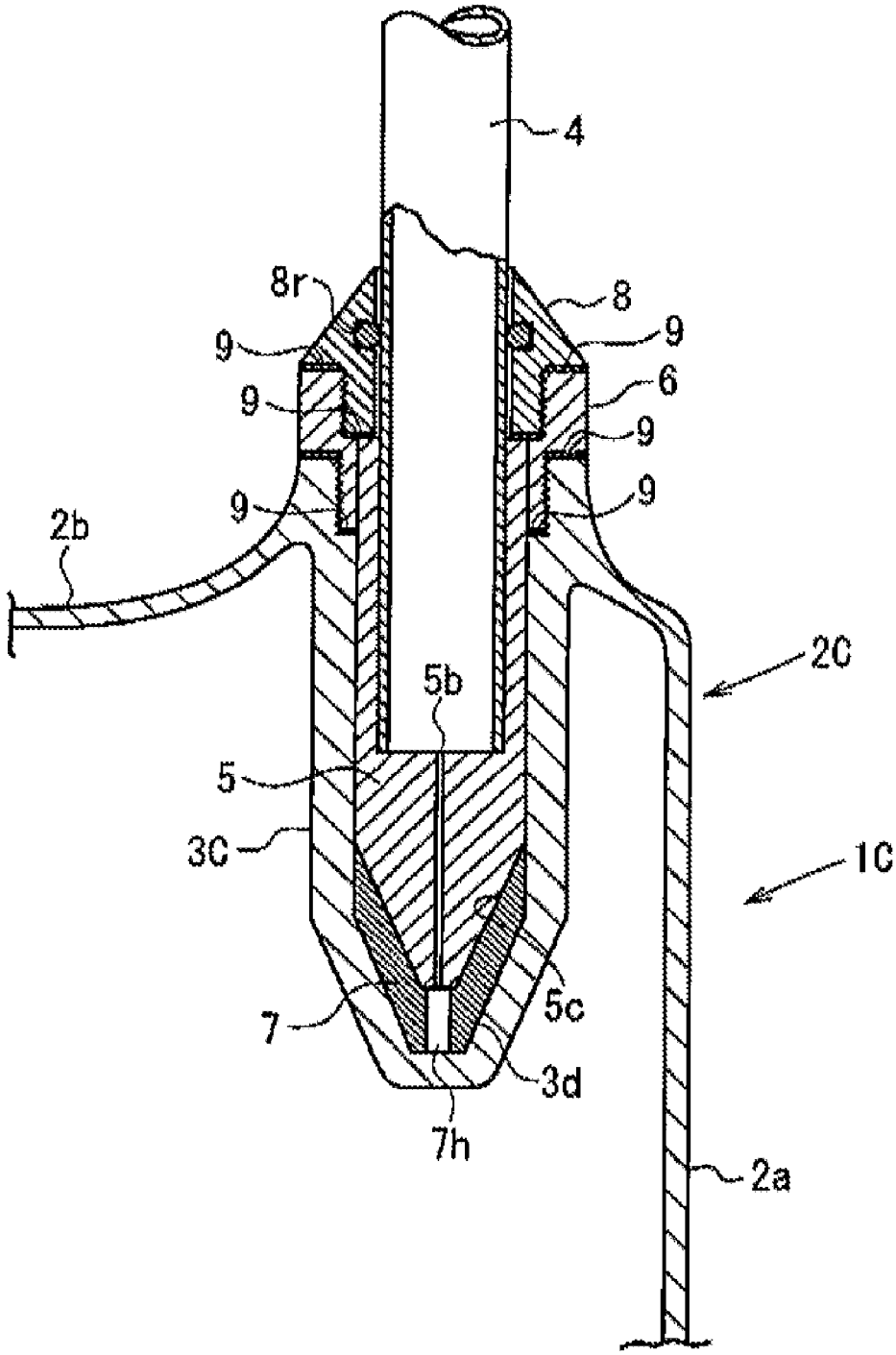
FIG. 10 is a section view of a golf club according to a third embodiment of the invention.

Embodiment Shown in FIG. 10

According to the invention, like a head 1C shown in FIG. 10, a head main body 2C and a hosel 3C may be formed as an integral body. The other remaining structures of FIG. 10 are the same as those of FIG. 3 and thus the same parts thereof are given the same designations. In FIG. 10, there is used an O ring 8*r*; however, like FIG. 9, there may also be used the sleeve 4*s*.

In this embodiment, a first screw member 6 is threadedly mounted on the upper end of the hosel 3, a shaft case 5D is inserted through the screw member 6 into the hosel 3, and a second screw member 11 is threadedly engaged with the screw member 6, whereby the shaft case 5D is fixed to the hosel 3.

Figure 12:
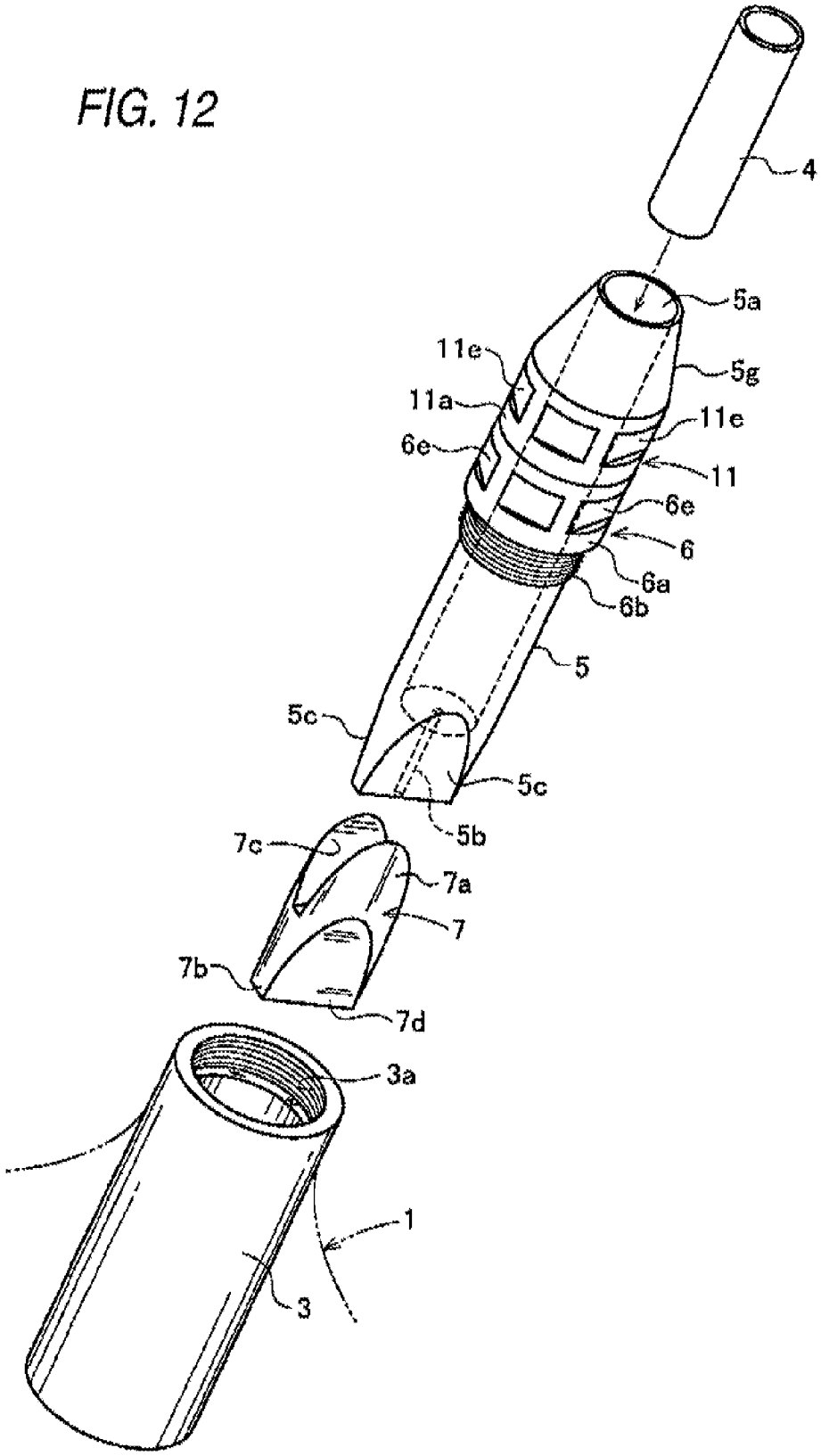
FIG. 12 is an exploded perspective view of the golf club shown in FIG. 11.

The screw member 6 is the same screw member that is used in the embodiment shown in FIGS. 1 to 8. That is, the lower half portion of the screw member 6 is formed smaller in diameter than the upper half portion 6*a*, a male screw 6*b* is formed in the outer peripheral surface of the lower half portion, and a female screw 6*d* is formed in the inner peripheral surface of the upper half portion 6*a*. However, according to the present embodiment, as shown in FIG. 12, in the outer peripheral surface of the upper half portion 6*a*, there are formed six plane portions 6*e*, thereby providing a nut-like shape. When a tool such as a monkey wrench or a spanner is applied to these plane portions 6*e*, the screw member 6 can be rotated.

The screw member 11 has a substantially ring shape that is substantially the same as the screw member 6. The lower half portion of the screw member 11 is formed smaller in diameter than the upper half portion 11*a* thereof and, in the outer peripheral surface of the lower half portion, there is cut formed a male screw 11*b*. According to this embodiment, as shown in FIG. 12, in the outer peripheral surface of the upper half portion 11*a*, there are formed six plane portions 11*e*, thereby providing a nut-like shape. When a tool such as a monkey wrench or a spanner is engaged with these plane portions 11*e*, the screw member 11 can be rotated. The inner hole of the screw member 11 is equal in diameter from the upper end to the lower end. In this respect, the screw member 11 is different in shape from the screw member 6. The other remaining portions of the shape of the screw member 11 are the same as the screw member 6.

The shaft case 5D used in this embodiment has a length which extends from the bottom of the hosel 3 to the outside of the hosel 3. On the outer peripheral surface of the middle portion of the shaft case 5D in the axial direction (longitudinal direction) thereof, there is provided a projecting portion 5*t*. This projecting portion 5*t* is a flange-like portion which extends around the shaft case 5. And, the projecting portion 5*t* has a diameter which allows the shaft case 5 to come into contact with the step surface 6*m* of the screw member 6 or the step surface 3*b* of the hosel 3 from above.

Integrally with the upper end of the shaft case 5D, there is mounted an umbrella-shaped portion 5*g* having a tapered outer peripheral surface the diameter of which decreases as it goes toward its upper end. This umbrella-shaped portion 5*g* has a circular truncated cone shape and, in the upper surface of the umbrella-shaped portion 5*g*, there is formed a shaft insertion hole 5*a*. The lower surface of the umbrella-shaped portion 5*g* is superimposed on the upper surface of the screw member 6 through a ring-shaped thin layer member 9.

The shaft case 5D includes a small diameter portion 5*h* which is formed continuously with the lower portion of the umbrella-shaped portion 5*g*. The screw member 6 is rotatably fitted with the outer surface of the small diameter portion 5*h*. The above-mentioned projecting portion 5*t* is disposed downwardly of the small diameter portion 5*h* of the shaft case 5D. The lower end face of the screw member 6 is contacted with the projecting portion 5*t* through a ring-shaped thin layer member 9.

Figure 11:
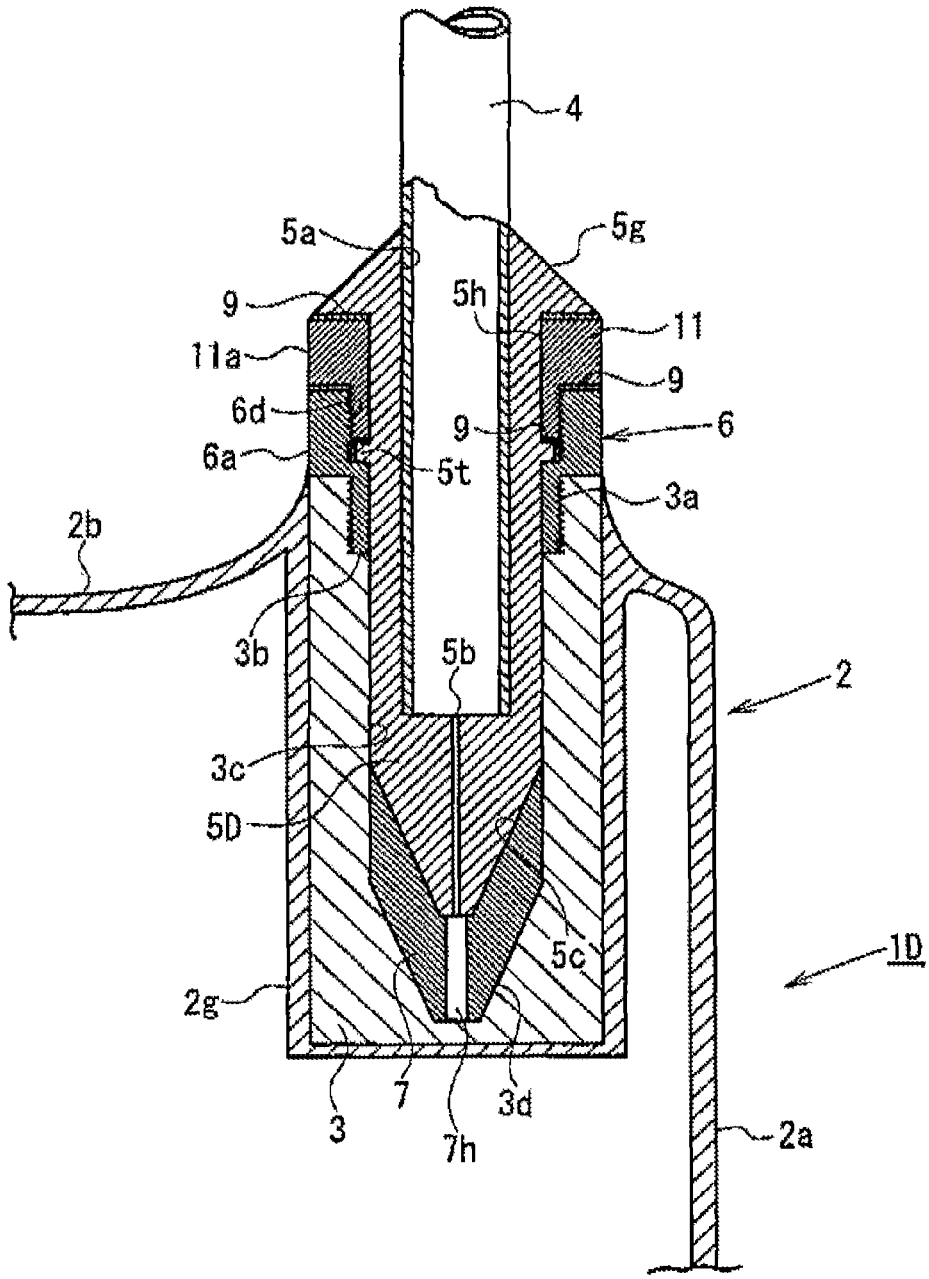
FIG. 11 is a section view of a golf club according to a fourth embodiment of the invention.
Figure 13:
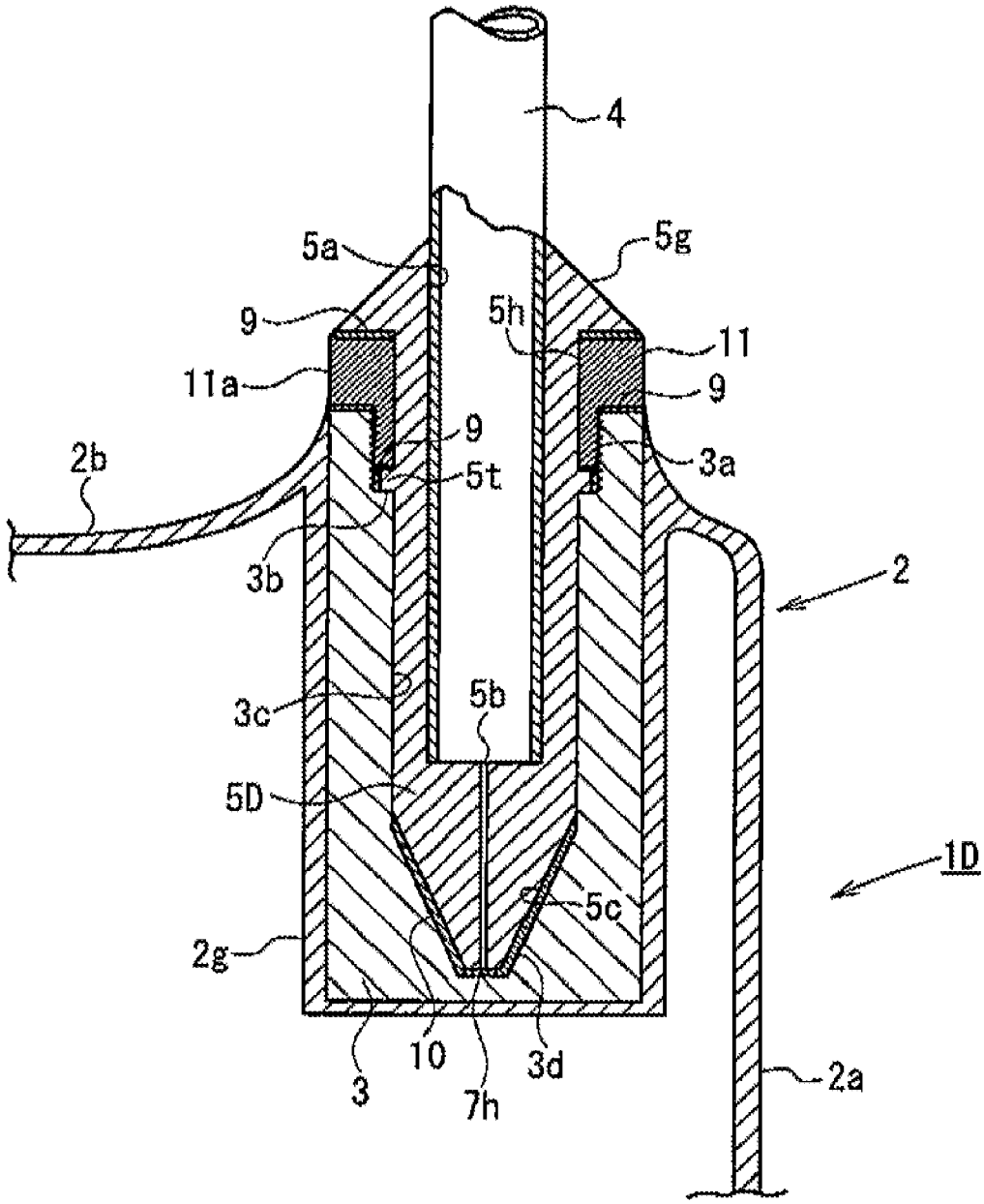
FIG. 13 is a section view of the golf club shown in FIG. 12, showing a case where the shaft insertion depth thereof is increased.

The hosel 3, spacer 7 and head main body 2 used in FIGS. 11 to 13 are respectively the same in structure as those used in FIGS. 1 to 8.

To assemble this golf club, similarly to the previously-mentioned embodiment, the leading end of the shaft 4 is inserted into the shaft insertion hole 5*a* of the shaft case 5D with the screw member 11 connected thereto and is fixed to the insertion hole 5*a* using an adhesive agent previously. Also, the spacer 7 is disposed on the bottom of the hosel 3 and the screw member 6 is screwed into the hosel 3 previously.

The shaft case 5D of the shaft case/shaft connected unit (in which the shaft case 5D is fixed to the shaft 4 in this manner) is inserted through the screw member 6 into the hosel hole 3H.

After the shaft case 5D is inserted into the hosel hole 3H in such a direction that the inclined surfaces 5*c* of the shaft case 5D and the inclined surfaces 7*d* of the spacer 7 can be superimposed on top of each other, the male screw 11*b* of the screw member 11 is threadedly engaged into the female screw 6*d* of the screw member 6.

As a result of this, as shown in FIG. 11, the lower end face of the screw member 11 and the step surface 6*m* of the screw member 6 hold and press the projecting portion 5*t* of the shaft case 5D between them, and the inclined surfaces 5*c* of the shaft case 5D are engaged with the inclined surfaces 3*d* of the hosel 3 through the spacer 7 respectively, whereby the shaft case 5D is fixed to the hosel 3. This completes the assembly of the golf club in which the shaft 4 and head 1D are formed as an integral body, because the shaft case 5D and shaft 4 are firmly bonded to each other with the adhesive agent.

To pull out the shaft case 5 from this golf club, the screw member 11 may be turned in its loosening direction. Since the male screw 11*b* of the screw member 11 is threadedly engaged with the female screw 6*d* of the screw member 6, when the screw member 11 turns in the loosening direction, the screw member 11 moves upwardly (threadedly moves) to push up the umbrella-shaped portion 5*g*, whereby the shaft case 5D is moved upwardly. As a result of this, the shaft case 5D moves in an upward direction where it parts away from the hosel 3, so that the shaft case 5D can be easily pulled out from the hosel 3.

After removal of the shaft case 5D from the hosel 3, when the screw member 6 is removed from the hosel 3 and the shaft case 5D is immediately screwed into the hosel 3 and the screw member 11 is threadedly engaged into the female screw 3*a* of the hosel 3, as shown in FIG. 13, the shaft 4 can be inserted into the hosel 3 deeply. The projecting portion 5*t* is held between and pressed by the lower end face of the screw member 11 and the step portion 3*b* of the hose 3.

Alternatively, by removing the shaft case 5D from the state shown in FIG. 11 and replacing the screw member 6 with a screw member having a different length in the axial direction, the insertion length of the shaft 4 can also be changed.

Here, according to the present embodiment as well, a shaft case with a screw member 11 of the same type as the shaft case 5 may be previously fixed to a replacing new shaft using an adhesive agent, and the shaft case/shaft connected unit of the existing golf club may be replaced with the new unit.

In the golf club shown in FIGS. 11 to 13, the umbrella-shaped portion 5*g* is formed to have a taper shape. However, alternatively, there may be formed an increasing diameter portion having a flat flange shape and a ferrule may be mounted on the upper portion of the flange-shaped increasing diameter portion.

In the above embodiments, the golf club is of a wood type. However, the invention can also apply to a golf club of any type such as a utility type, an iron type, or a patter type.

What is claimed is:

1. A golf club, comprising:

a head;

a shaft;

a shaft case, having a cylindrical shape and fixed to a leading end of the shaft, a hosel, mounted on the head, a spacer, disposed between the lower end of the shaft case and a bottom portion of the hosel;

a female screw, formed in an inner peripheral surface of the upper end of the hosel;

a first screw member, threadedly engaged with an upper end of the hosel, the first screw member being concentrically with the hosel;

a female screw, formed in the inner peripheral surface of an upper end of the first screw member;

a second screw member, including a male screw being threadedly engaged with the female screw of the first screw member, wherein the shaft case is inserted into the hosel from the upper end of the hosel; and the shaft case is fixed to the hosel so that an insertion depth of the shaft into the hosel is changed, wherein the shaft case is fixed to the hosel by a ring-shaped screw member removably screwed on the upper end of the hosel, wherein when the spacer and the first screw member are removed and the second screw member is threadedly engaged with the female screw of the hosel directly, the insertion depth of the shaft is increased.

2. The golf club according to claim 1, wherein a lower end face of the screw member is pressed against an upper end face of the shaft case.

3. The golf club according to claim 1, further comprising a projecting portion, provided on an outer peripheral surface of the shaft case, wherein the lower end face of the second screw member is pressed against the projecting portion.

4. The golf club according to claim 1, wherein the spacer includes an engaging unit, configured to engage a jig which is used to pull out the spacer from the hosel.

5. The golf club according to claim 4, wherein the engaging unit is a female screw.

6. A method for changing the shaft insertion depth of the golf club according to claim 1, the method comprising:

removing the second screw member from the first screw member;

removing the first screw member from the hosel;

pulling out the shaft case from the hosel;

taking out the spacer from the hosel;

inserting the shaft case into the hosel; and threadedly engaging the second screw member with the hosel.

7. The method according to claim 6, further comprising providing a weight adjusting portion in the head; and adjusting the insertion depth based on a weight of the head.

8. A method for changing the insertion depth of the shaft of the golf club according to claim 1, the method comprising:

replacing the second screw member and spacer with another second screw member and spacer which are different in length in the axial direction of the hosel.

* * * * *